US010900098B2

(12) United States Patent
Kozuka et al.

(10) Patent No.: US 10,900,098 B2
(45) Date of Patent: Jan. 26, 2021

(54) THERMAL TREATMENT FURNACE

(71) Applicant: DAIDO STEEL CO., LTD., Nagoya (JP)

(72) Inventors: Toshiyuki Kozuka, Nagoya (JP); Yoshinobu Kondo, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 112 days.

(21) Appl. No.: 16/026,706

(22) Filed: Jul. 3, 2018

(65) Prior Publication Data

US 2019/0010568 A1 Jan. 10, 2019

(30) Foreign Application Priority Data

Jul. 4, 2017 (JP) ..... 2017-131112
Apr. 14, 2018 (JP) ..... 2018-078044

(51) Int. Cl.
*C21D 9/00* (2006.01)
*C21D 9/63* (2006.01)

(52) U.S. Cl.
CPC ..... *C21D 9/0018* (2013.01); *C21D 9/0056* (2013.01); *C21D 9/63* (2013.01)

(58) Field of Classification Search
CPC ..... C21D 9/0018; C21D 9/0056; C21D 9/63
USPC ..... 266/113, 252, 111, 46; 148/559, 638, 148/661
See application file for complete search history.

(56) References Cited

U.S. PATENT DOCUMENTS 4,367,597 A 1/1983 Iida et al.
4,934,445 A 6/1990 Plata et al.
6,091,055 A * 7/2000 Naka ..... F27B 9/2476 219/388
2009/0229712 A1 9/2009 Ylimainen
2011/0018178 A1 1/2011 Muller et al.
2014/0047729 A1 2/2014 Muller et al.
2018/0327876 A1* 11/2018 Schaefer ..... C21D 9/573

FOREIGN PATENT DOCUMENTS

CN 101454466 A 6/2009
CN 101970141 A 2/2011
CN 102121063 A 7/2011
CN 102268517 A 12/2011
CN 104254622 A 12/2014
(Continued)

OTHER PUBLICATIONS

Korean Office Action, dated Sep. 11, 2019, in Korean Application No. 10-2018-0077747 and English Translation thereof.
(Continued)

*Primary Examiner* — Scott R Kastler
*Assistant Examiner* — Michael Abogaye
(74) *Attorney, Agent, or Firm* — McGinn I.P. Law Group, PLLC.

(57) ABSTRACT

A thermal treatment furnace includes a thermal treatment chamber in which a thin metal sheet is continuously conveyed horizontally while being floated by air, in which the thermal treatment chamber includes a plurality of air injection nozzles and a plurality of mist spray nozzles that are arranged along a pass line of the thin metal sheet in the thermal treatment chamber, on a lower side and an upper side of the pass line and so as to be orthogonal to the pass line in a side view.

18 Claims, 5 Drawing Sheets

(56) References Cited

FOREIGN PATENT DOCUMENTS

| | | | | | |
|---|---|---|---|---|---|
| JP | S53-146908 | A | | 12/1978 | |
| JP | S56-084456 | A | | 7/1981 | |
| JP | S59-109765 | U | | 7/1984 | |
| JP | S60-043434 | A | | 3/1985 | |
| JP | S61-048580 | A | | 3/1986 | |
| JP | 2009-538987 | A | | 11/2009 | |
| WO | WO 2013/102702 | A1 | | 7/2013 | |
| WO | WO2017133867 | | * | 8/2017 | ..... C21D 9/0018 |

OTHER PUBLICATIONS

Chinese Office Action, dated Oct. 24, 2019, in Chinese Application No. 201810724092.6 and English Translation thereof.

Chinese Office Action, dated Jun. 15, 2020, in Chinese Patent Application No. 201810724092.6 and English Translation thereof.

Practical Handbook of Copper Processing Technology, Weijia Zhong, Jan. 2007, Beijing: Metallurgical Industry Press, Edition 1, pp. 861-863 and English Translation thereof.

Korean Notice of Decision to Rejection, dated Mar. 26, 2020, for Korean Patent Application No. 10-2018-0077747, and English Translation thereof.

Chinese Office Action, dated Nov. 11 2020, in Chinese Application No. 201810724092.6 and English Translation thereof.

* cited by examiner

THERMAL TREATMENT FURNACE

TECHNICAL FIELD

The present invention relates to a continuous thermal treatment furnace (so-called floating furnace) in which a thin metal sheet is successively subjected to heating, thermal treatment and cooling while floating the thin metal sheet with air.

BACKGROUND ART

For example, for cooling a thermal-treated metal material, which is accommodated and travels along a horizontal direction in a thermal treatment furnace which is continuously operated, the following method for controlling the metal material in the thermal treatment furnace has been proposed (e.g., Patent Document 1). That is, the metal material is controlled such that a trajectory of the metal material between rollers, which support the metal material, is measured by a measuring device and the trajectory obtained based on the measurement result is made to travel between conveying devices of a cooling agent (air, inert gas, liquid, or a mixture of gas and liquid) to be injected for cooling the metal material.

Here, as for a thermal treatment furnace of a floating type in which a thin metal sheet is floated by air and the thin metal sheet after being heated is cooled by injecting a refrigerant such as air, various investigations have been made on an optimum injection conditions of the refrigerant such as air.

However, for example, in order to enhance a cooling rate of a thin metal sheet by an injection of only air (one type of refrigerant), there is a limit due to a pressure of the air or the like. Therefore, it is required to enhance an injection speed of the refrigerant for cooling the thin metal sheet, to further shorten an injection distance of the refrigerant, or the like. However, no effective proposal has been made for the above technical problems so far.

Patent Document 1: JP-T-2009-538987

SUMMARY OF THE INVENTION

An object of the present invention is to provide a thermal treatment furnace capable of solving the problems described in the background art, enhancing cooling efficiency for a thin metal sheet during a thermal treatment or after the thermal treatment, which is conveyed along a horizontal direction while being floated by air, and easily selecting various cooling rates.

In order to solve the above problems, the present inventors considered enabling injection of mist by a mist spray nozzle or injection of multiple water droplets by a water droplet injection nozzle, in addition to injection of air by an air injection nozzle, with respect to a thin metal sheet conveyed along the horizontal direction while being floated by air. The present invention has been made based on the findings therefrom.

That is, the thermal treatment furnace according to a first aspect of the present invention is a thermal treatment furnace for performing a thermal treatment on a thin metal sheet while continuously conveying the thin metal sheet through a heating chamber, a thermal treatment chamber and a cooling chamber while floating the thin metal sheet, in which at least the thermal treatment chamber contains a plurality of air injection nozzles and a plurality of mist spray nozzles, or the plurality of air injection nozzles and a plurality of water droplet injection nozzles, and in which the plurality of air injection nozzles and the plurality of mist spray nozzles, or the plurality of air injection nozzles and the plurality of water droplet injection nozzles are arranged along a pass line of the thin metal sheet in the thermal treatment chamber, on a lower side and an upper side of the pass line and so as to be orthogonal or oblique to the pass line in a side view.

According to the thermal treatment furnace as described above, the following effect (1) can be achieved.

(1) The plurality of air injection nozzles and plurality of mist spray nozzles, or the plurality of air injection nozzles and plurality of water droplet injection nozzles are arranged so as to be orthogonal or oblique to the pass line in the side view on the lower side and the upper side of the pass line along the pass line of the thin metal sheet. As a result, high pressure air and a mist to be injected are used in combination, or the high pressure air and a water droplet to be injected are used in combination. Therefore, both surfaces of the thin metal sheet can be efficiently cooled depending on the sheet thickness, conveying speed or the like, the cooling rate can be enhanced, and a cooling time can be shortened.

The thin metal sheet is, for example, a rolled steel sheet, an aluminum alloy sheet or the like, and has a sheet thickness of mainly several mm (e.g., 3 mm) or less.

The thermal treatment furnace contains the heating chamber, the thermal treatment chamber and the cooling chamber that are linearly provided, and the thermal treatment furnace is a continuous thermal treatment furnace in which the thin metal sheet is sequentially heated, thermal treated and cooled along the pass line.

Furthermore, an air injection nozzle for injecting high temperature air for heating the thin metal sheet is arranged in the heating chamber, and at least one of the air injection nozzle, the mist spray nozzle and the water droplet injection nozzle for cooling is arranged in the cooling chamber.

In addition, each air injection nozzle of the plurality of air injection nozzles may be arranged corresponding to the respective positions of a lattice pattern or houndstooth pattern in plan view or in bottom view.

In addition, in the present invention, mist refers to minute water droplet particles having a diameter of less than 100 μm, and water droplet refers to water droplet particles having a diameter of 100 μm or more.

In addition, groups of the plurality of air injection nozzles and the plurality of mist spray nozzles or water droplet injection nozzles are arranged on the lower side and the upper side of the pass line. Furthermore, among these groups, a plurality of sets of air pads or the like for floating the thin metal sheet from its lower surface side are arranged alternately on the lower side and the upper side.

In addition, in the thermal treatment furnace of a second aspect of the present invention, the mist spray nozzles or the water droplet injection nozzles are arranged to be adjacent to each of the air injection nozzles and in parallel with each other.

According to this aspect, mist injected from the mist spray nozzle or multiple water droplets injected from the water droplet injection nozzle can be reliably injected on both surfaces of the thin metal sheet on the flow of high speed air injected from the adjacent air injection nozzle. Therefore, the effect (1) can be more reliably achieved.

The term "adjacent" means that the distance between the air injection nozzle and the mist spray nozzle or the distance between the air injection nozzle and the water droplet injection nozzle is, for example, the same as or smaller than the outer diameter of one of these nozzles.

In addition, one or a plurality (any one of two to four) of the mist spray nozzles or water droplet injection nozzles are arranged adjacent to one air injection nozzle.

Furthermore, in the thermal treatment furnace of a third aspect of the present invention, the mist spray nozzle or the water droplet injection nozzle is configured such that at least a tip portion of the mist spray nozzle or the water droplet injection nozzle is inclined toward the adjacent air injection nozzle.

According to this aspect, since the mist injected from the mist spray nozzle or multiple water droplets injected from the water droplet injection nozzle can be accurately fed to an injection port side of the air injection nozzle arranged adjacent to each of these nozzles, the mist or multiple water droplets can surely be made to ride on the flow of the high speed air injected from the air injection nozzle and can be injected more reliably onto both surfaces of the thin metal sheet. Therefore, the effect (1) can be more remarkably achieved.

The "inclination" means that the main body of the mist spray nozzle or water droplet injection nozzle or at least the tip portion thereof is inclined within the range of 1 degree or more and 45 degrees or less (preferably 1 degree to 30 degrees, and more preferably 1 degree to 15 degrees) with respect to an axial direction of the adjacent air injection nozzle.

In addition, in the thermal treatment furnace of a fourth aspect of the present invention, groups of the plurality of air injection nozzles and the plurality of mist spray nozzles or groups of the plurality of air injection nozzles and the plurality of water droplet injection nozzles are alternately arranged on the lower side and the upper side of the pass line along the pass line.

According to this aspect, the following effect (2) can be further achieved in addition to the effect (1).

(2) Since the thin metal sheet can be conveyed while being floated in a continuous loose corrugation shape along the pass line in a side view, the thin metal sheet can be cooled relatively uniformly and evenly without damaging both surfaces thereof.

An air pad or the like for floating the thin metal sheet from both the lower surface side and the upper surface side is arranged among the groups of the plurality of air injection nozzles and plurality of mist spray nozzles, or among the groups of the plurality of air injection nozzles and plurality of water droplet injection nozzles, arranged alternately on the lower side and the upper side of the pass line.

In addition, the thermal treatment furnace of a five aspect of the present invention further contains a roller supporting the thin metal sheet from the lower side on the lower side of the pass line on at least one of a vicinity of a boundary between the heating chamber and the thermal treatment chamber and a vicinity of a boundary between the thermal treatment chamber and the cooling chamber.

According to this aspect, the following effects (3) and (4) can be further achieved in addition to the effects (1) and (2).

(3) In the case where the pressure of the air for floating the thin metal sheet unexpectedly decreases or the air supply suddenly stops, the thin metal sheet can be prevented from hanging down in the thermal treatment chamber and being damaged by coming into contact with the air injection nozzle of the lower surface side or a projection portion described later.

(4) In the case where the air from the air pad injected for floating the thin metal sheet interferes with the mist injected from the mist spray nozzle, which is made to ride on the flow of air injected from the adjacent air injection nozzle to be injected onto both surfaces of the thin metal sheet, the thin metal sheet can be supported from the lower side by the roller even when the supply of the air for floating the thin metal sheet is stopped. Therefore, the thin metal sheet can be reliably cooled without being damaged.

A peripheral surface of the roller may be wrapped with a sheet of synthetic rubber or synthetic resin having both heat resistance and elasticity not damaging the surface of the thin metal sheet.

In addition, the roller preferably has a structure in which a hollow portion for storing a refrigerant such as cooling water for preventing the temperature rise of the roller itself is provided inside the roller.

Furthermore, it is recommended that the roller also has a support portion with a support mechanism capable of adjusting the height of the peripheral surface.

MODE FOR CARRYING OUT THE INVENTION

Hereinafter, embodiments for performing the present invention will be described.

Figure 1A:
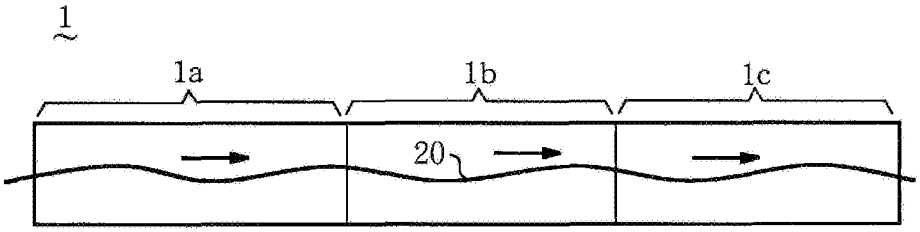
FIG. 1A is a side view illustrating an outline of a thermal treatment furnace of the present invention.

A thermal treatment furnace 1 of the present invention contains a heating chamber 1*a*, a thermal treatment chamber 1*b*, and a cooling chamber 1*c*, which are linearly arranged along a horizontal direction as illustrated in FIG. 1A. The thermal treatment furnace 1 is configured to be capable of continuously conveying a thin metal sheet 20 in these chambers from the left side to the right side in the drawing while floating the thin metal sheet 20 with air described later, as indicated by arrows in the drawing.

In the heating chamber 1*a*, the thin metal sheet 20 is heated from a room temperature to a required temperature range. In the thermal treatment chamber 1*b*, the heated thin metal sheet 20 is hardened by quenching, for example. In the cooling chamber 1*c*, the thin metal sheet 20 after the thermal treatment is cooled to near the room temperature.

Figure 1B:
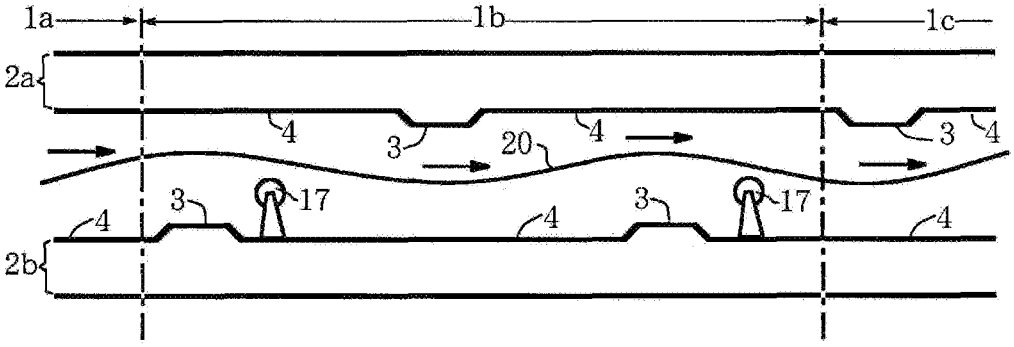
FIG. 1B is a vertical cross-sectional view schematically illustrating a vicinity of a thermal treatment chamber in the thermal treatment furnace of FIG. 1A.

More specifically, as illustrated in the vertical cross-sectional view in a vicinity of the thermal treatment chamber 1*b* in FIG. 1B, the thin metal sheet 20 that has received a floating pressure by the air is continuously conveyed from the left side to the right side in the drawing so as to draw a corrugated shape (e.g., sine curve shape) in a side view between a plurality of projection portions 3 and a plurality of horizontal surfaces 4 that are arranged alternately along a longitudinal direction in a pair of upper and lower ducts 2*a* and 2*b* along the horizontal direction.

The thin metal sheet 20 can be exemplified by a sheet formed of, for example, an aluminum alloy, and rolled to have a thickness of 3 mm or less.

In a vicinity of a boundary between the thermal treatment chamber 1*b* and the heating chamber 1*a* and in a vicinity of a boundary between the thermal treatment chamber 1*b* and the cooling chamber 1*c* as indicated by a one-dot chain line in FIG. 1B, rollers 17 are individually installed on the horizontal surface 4 of the lower duct 2*b*. These rollers 17 are provided for supporting the thin metal sheet 20 from the lower surface side when supply of the floating air described above is stopped inadvertently or when stopping the supply of the floating air in the case where the air floating the thin metal sheet 20 interferes the mist (22) so as not to adhere to the thin metal sheet 20.

Figure 1C:
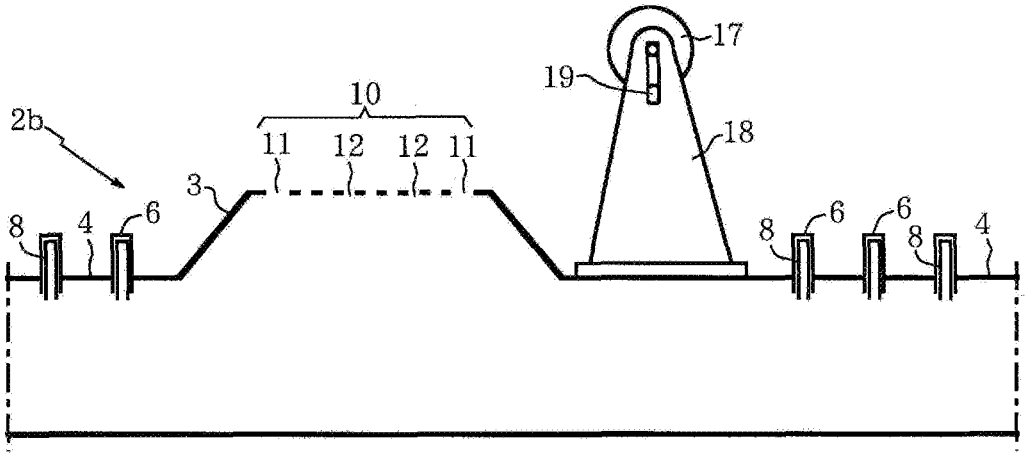
FIG. 1C is a partially enlarged view of the FIG. 1B, illustrating a vicinity of a roller installed at a vicinity of a boundary between the thermal treatment chamber and a cooling chamber.

As illustrated in FIG. 1C, the roller 17 is mounted on the horizontal surface 4 of the lower duct 2*b* so as to be movable up and down along a vertical direction, via a pair of front and rear support legs 18 erected on the horizontal surface 4 of the lower duct 2*b* and a longitudinally elongated hole 19 provided on an upper end side of the support leg 18. At least a peripheral surface of the roller 17 is wrapped with a sheet of synthetic rubber or synthetic resin having elasticity. For the synthetic resin, polyimide (PI) excellent in heat resistance is recommended. Furthermore, a hollow portion capable of storing cooling water, for example, is preferably formed in an interior of the roller 17 installed near the boundary with the heating chamber 1*a*.

At the boundary between the heating chamber 1*a* and the thermal treatment chamber 1*b* and at the boundary between the thermal treatment chamber 1*b* and the cooling chamber 1*c* indicated by the one-dot chain line in FIG. 1B, the ducts 2*a* and 2*b* are blocked inside thereof. In addition, details of an air pad indicated by reference numeral 10 (11, 12) in FIG. 1C will be described later.

Figure 2A:
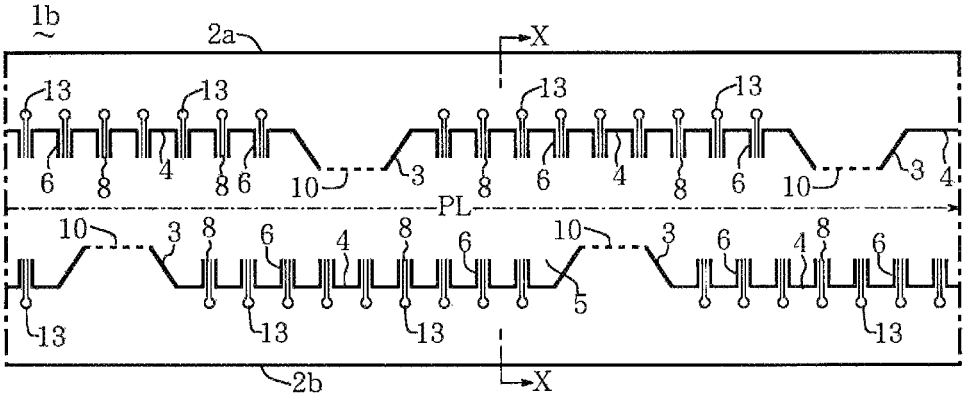
FIG. 2A is a vertical cross-sectional view illustrating the thermal treatment chamber of the thermal treatment furnace of FIG. 1A.
Figure 2B:
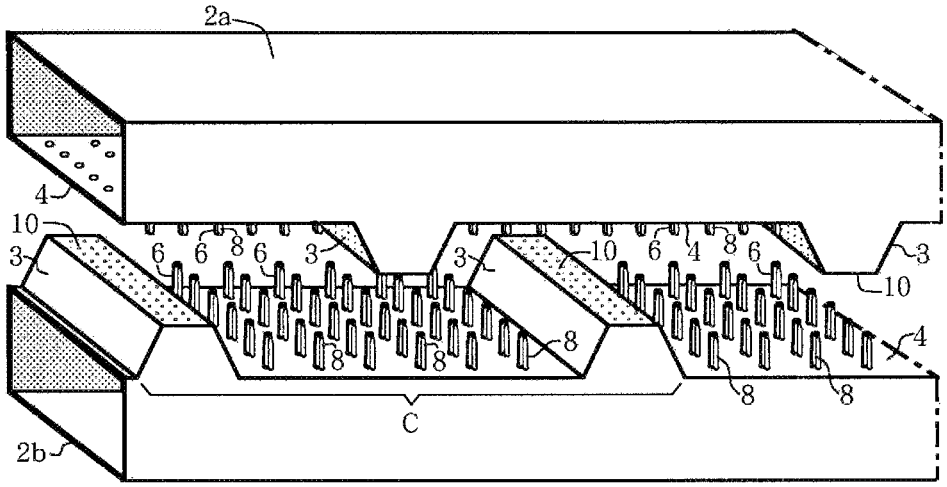
FIG. 2B is a perspective view of the thermal treatment chamber of FIG. 2A.
Figure 2C:
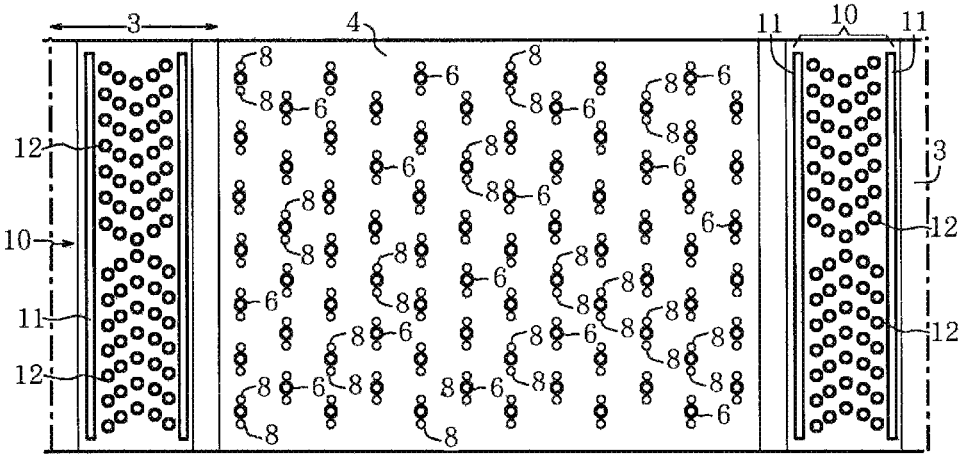
FIG. 2C is a partial plan view illustrating a region C of a lower duct in FIG. 2B.
Figure 3:
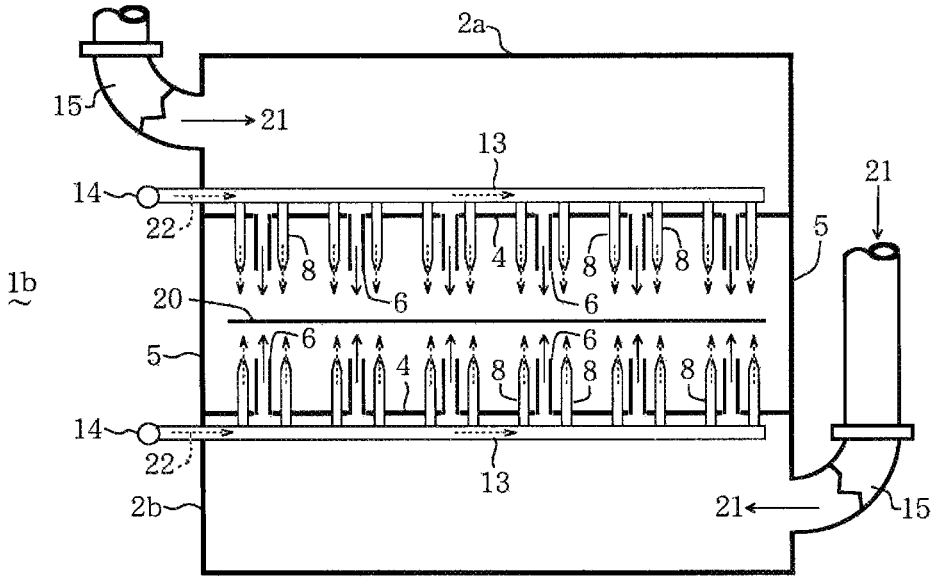
FIG. 3 is a vertical cross-sectional view taken along arrow line X-X in FIG. 2A.

FIG. 2A is a vertical cross-sectional view illustrating a main part of the thermal treatment chamber 1*b*, FIG. 2B is a perspective view illustrating a part of the thermal treatment chamber 1*b*, and FIG. 2C is a partial plan view illustrating a region C of the lower duct 2*b* in FIG. 2B. FIG. 3 is a vertical cross-sectional view taken along the arrow line X-X in FIG. 2A.

As illustrated in FIG. 2A, FIG. 2B, FIG. 2C, and FIG. 3, the thermal treatment chamber 1*b* is configured to include a pair of the upper and lower ducts 2*a* and 2*b* and a pair of right and left side walls 5 connecting between both side surfaces of the ducts 2*a* and 2*b*. The upper and lower ducts 2*a* and 2*b* are arranged apart from each other along the upper and lower sides of a pass line PL of the thin metal sheet 20, which is horizontal and is parallel to a floor (not illustrated).

The upper duct 2*a* and the lower duct 2*b* have an oblong (rectangular) external shape in vertical cross section, and as illustrated in FIG. 3, high pressure air 21 which is increased in pressure is supplied from individual air supply pipes 15 into each of the hollow portions of these ducts.

The upper duct 2*a* and the lower duct 2*b* alternately have a plurality of horizontal surfaces 4 opposed to each other and the projection portion 3 having an inverse trapezoidal or a trapezoidal cross shape interposed between the horizontal surfaces 4 along the pass lines PL. And as illustrated in FIG. 2A, the upper and lower projection portions 3 are alternately arranged along the pass line PL.

As illustrated in FIG. 2B and FIG. 2C, on each horizontal surface 4 of the ducts 2*a* and 2*b*, a plurality of air injection nozzles (hereinafter simply referred to as air nozzles) 6 are vertically provided in a houndstooth pattern in plan view. And a pair of left and right mist spray nozzles (hereinafter simply referred to as mist nozzles) 8 is vertically provided adjacent to each of the air nozzles 6 in the direction orthogonal to the pass line PL.

The plurality of air nozzles 6 may be vertically provided in a lattice pattern in plan view.

In addition, on the top surface or the bottom surface of the projection portion 3, an air pad 10 is formed as illustrated in FIG. 2C. The air pad 10 is configured to include a pair of slit holes 11 whose longitudinal direction is orthogonal to the pass line PL and multiple round holes 12 arranged between these slit holes 11. The air pad 10 makes the thin metal sheet 20 float with air 21 and facilitates conveyance of the thin metal sheet 20 along the pass line PL.

Figure 4A:
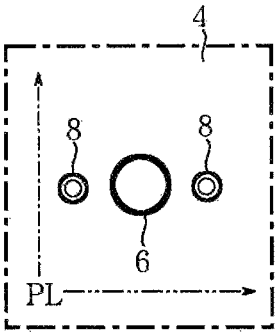
FIG. 4A is a partial plan view illustrating a vicinity of one air injection nozzle.

A pair of mist nozzles 8 is vertically provided on the horizontal surface 4 of the lower duct 2*b* so as to be adjacent to and to interpose the air nozzle 6 therebetween in the direction orthogonal to the pass line PL in FIG. 2C. But as illustrated in FIG. 4A, a pair of mist nozzles 8 may be vertically provided along the direction parallel to the pass line PL so as to be adjacent to and to interpose the air nozzle 6 therebetween. The individual mist nozzles 8 and the air nozzle 6 are made to be adjacent to each other so that the gaps therebetween are equal to or smaller than the outer diameter of the air nozzle 6.

Figure 4B:
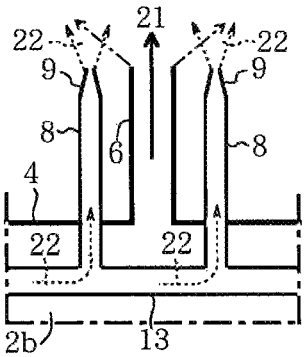
FIG. 4B is a vertical cross-sectional view illustrating the vicinity of the air injection nozzle of FIG. 4A.

As illustrated in FIG. 3 and FIG. 4B, the pair of mist nozzles 8 is provided vertically from a plurality of mist supply pipes 13 as to penetrate through the horizontal surface 4 of the ducts 2*a* and 2*b*. The mist supply pipes 13 are piped to be branched from header pipes 14 along the ducts 2*a* and 2*b* into the hollow portion of the ducts 2*a* and 2*b* along the direction orthogonal to the pass line PL. The mist nozzle 8 has a conical tip portion 9.

As illustrated in FIG. 4B, the mist (multiple minute water droplet particle groups) 22 injected in a spray form from the pair of mist nozzles 8 is caught in the flow of the high pressure air 21 injected from the adjacent air nozzle 6, to be injected onto the lower side surface of the thin metal sheet 20 being conveyed along the pass line PL.

Figure 4C:
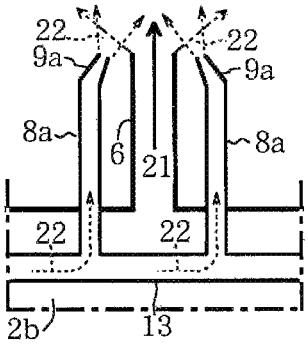
FIG. 4C is a vertical cross-sectional view similar to FIG. 4B having a mist spray nozzle of a different form.

In addition, as illustrated in FIG. 4C, the pair of mist nozzles 8*a* may be formed such that they are provided symmetrically to each other and adjacent to one air nozzle 6 and that the respective tip portions 9*a* is symmetrically inclined toward the air nozzle 6 side. In an illustrated form, the tip portion 9*a* of each mist nozzle 8*a* is inclined by approximately 20 degrees toward the air nozzle 6, but the inclination angle is appropriately selected from the range of 1 to 45 degrees.

In the form in which the tip portions 9*a* of the pair of mist nozzles 8*a* are symmetrically inclined toward the air nozzle 6 side, the mist 22 injected in a spray form from the pair of mist nozzles 8*a* is further reliably made to ride on the flow of the high pressure air 21 injected from the adjacent air nozzle 6, to be injected onto the lower side surface of the thin metal sheet 20.

Figure 5:
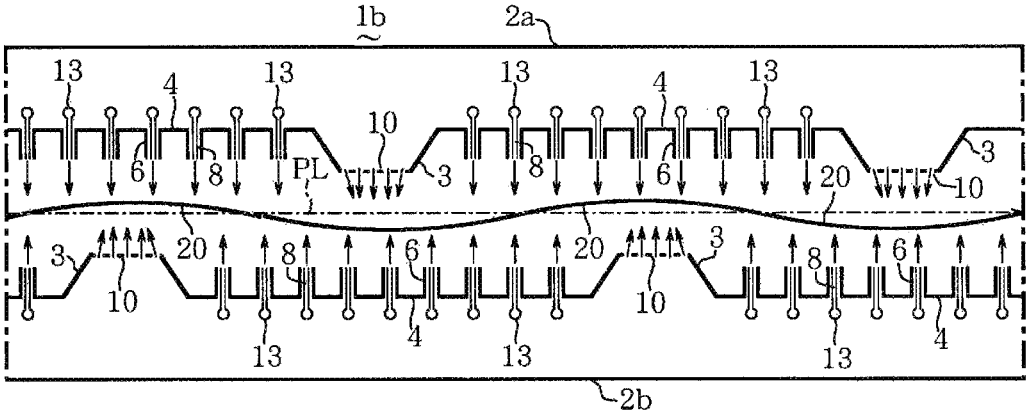
FIG. 5 is a vertical cross-sectional view similar to FIG. 2A, illustrating action in the thermal treatment chamber.

As illustrated in FIG. 5, the elongated thin metal sheet 20 quenched in the thermal treatment chamber 1*b* is conveyed from the left side to the right side in the drawing along the horizontal pass line PL between the upper and lower ducts 2*a* and 2*b*, while being floated by the high pressure air 21 blown out from the air pad 10 for each of the projection portions 3. The thin metal sheet 20 is pulled by a take-up roll (not illustrated) on the downstream side (right side in FIG. 5) of the pass line PL and wound into a coil shape on the peripheral surface of the roll.

Under the above condition, the thin metal sheet 20 having a temperature of several hundred degrees of Celsius exhibits a gentle corrugated shape along the pass line PL during being conveyed. And as indicated by arrows in the vertical direction in FIG. 5, the high pressure air 21 near the room temperature and the mist 22 near the room temperature are continuously blown onto the entire both surfaces of the thin metal sheet 20 from multiple (plural) air nozzles 6 vertically provided for each horizontal surface 4 of the ducts 2*a* and 2*b* and from multiple (plural) mist nozzles 8 vertically provided on the horizontal surface 4 adjacent to each of the air nozzles 6.

As a result, the thin metal sheet 20 is efficiently cooled to near the room temperature at a high cooling rate by the synergistic action of the high pressure air 21 and the mist 22 injected on both surfaces thereof, and the cooling time required for such a cooling process is also shortened. Furthermore, the mist 22 injected from each mist nozzle 8 can be injected onto both surfaces of the thin metal sheet 20 while making the mist 22 ride on the flow of the high speed air 21 injected from the adjacent air nozzle 6.

In addition, since the thin metal sheet 20 can be conveyed while being floated in a continuous loose corrugated shape along the pass line PL in a side view, both surfaces thereof can be cooled relatively uniformly and evenly in a relatively short time without damaging the thin metal sheet 20.

The cooling chamber 1*c* also has ducts 2*a* and 2*b* with air nozzles 6 and mist nozzles 8 arranged in a pattern similar to that in the thermal treatment chamber 1*b*.

In addition, in ducts 2*a* and 2*b* of the heating chamber 1*a*, air nozzles 6 for injecting high temperature air 21 are arranged in an appropriate pattern.

Therefore, according to the thermal treatment furnace 1 including the thermal treatment chamber 1*b*, the effects (1) and (4) can be reliably achieved.

Figure 6A:
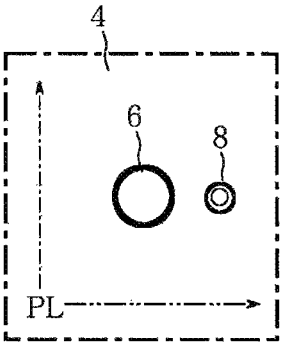
FIG. 6A is a partial plan view illustrating the vicinity of one air injection nozzle of a different form.
Figure 6B:
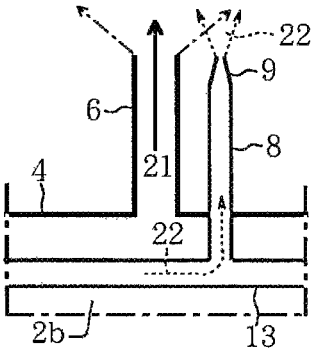
FIG. 6B is a vertical cross-sectional view illustrating the vicinity of the air injection nozzle of FIG. 6A.

As illustrated in FIG. 6A and FIG. 6B, one mist nozzle 8 may be vertically provided along the pass line PL or along a direction orthogonal to the pass line PL, with respect to one vertical air nozzle 6. Even in this form, the mist nozzle 8*a* in which the tip portion 9*a* is inclined toward the air nozzle 6 may be used.

Figure 7A:
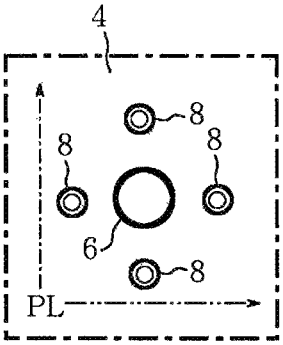
FIG. 7A is a partial plan view illustrating the vicinity of one air injection nozzle of another different form.
Figure 7B:
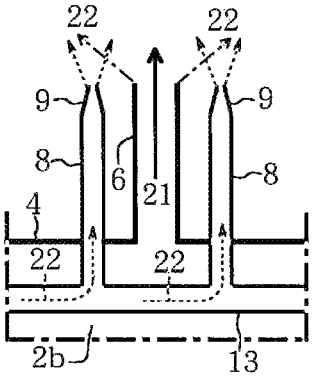
FIG. 7B is a vertical cross-sectional view illustrating the vicinity of the air injection nozzle of FIG. 7A.

In addition, as illustrated in FIG. 7A and FIG. 7B, a total of four mist nozzles 8 may be vertically provided so as to be point-symmetrical with respect to one vertical air nozzle 6, including two arranged in the direction along the pass line PL and two arranged in the direction along a direction orthogonal to the pass line PL. Even in such a form, all of the four mist nozzles 8 may be the mist nozzles 8*a* in which the tip portion 9*a* is inclined toward the air nozzle 6 side. Alternatively, three mist nozzles 8 (8*a*) with one of the four mist nozzles 8 (8*a*) omitted may be vertically provided adjacent to the air nozzle 6. Furthermore, the three mist nozzles 8 (8*a*) may be arranged at each corner of an equilateral triangle with the air nozzle 6 as the center of gravity in plan view.

Figure 8A:
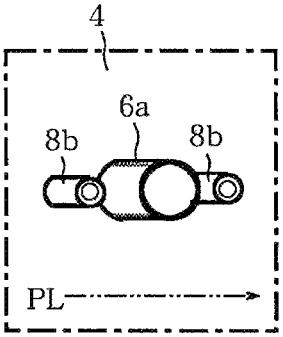
FIG. 8A is a partial plan view illustrating the vicinity of one air injection nozzle of still another different form.
Figure 8B:
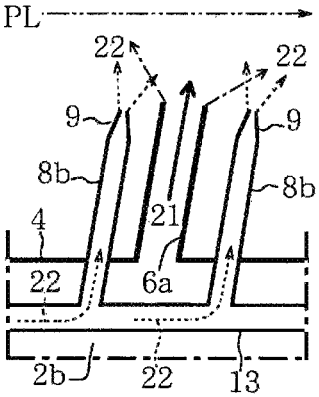
FIG. 8B is a vertical cross-sectional view illustrating the vicinity of the air injection nozzle of FIG. 8A.

Furthermore, as illustrated in FIG. 8A and FIG. 8B, one air nozzle 6*a* may be disposed so that its main body is inclined within the range of approximately 10 to 20 degrees toward the downstream side of the pass line PL with respect to an imaginary vertical line orthogonal to the horizontal surface 4 of the pass line PL and the duct 2*b* (2*a*), and one to four mist nozzle(s) 8*b* whose main body is inclined within the same range as described above may be disposed so as to be adjacent to the air nozzle 6*a* in the same manner as described above.

Alternatively, depending on the thermal treatment conditions such as the cooling rate of the thin metal sheet 20, the one air nozzle 6*a* and the one to four mist nozzle(s) 8*b* may be appropriately inclined within the range of approximately 10 to 20 degrees toward the upstream side of the pass line PL.

The inclination angle of each of the mist nozzles 8*b* may be set larger than the inclination angle of the air nozzle 6*a*.

Figure 9A:
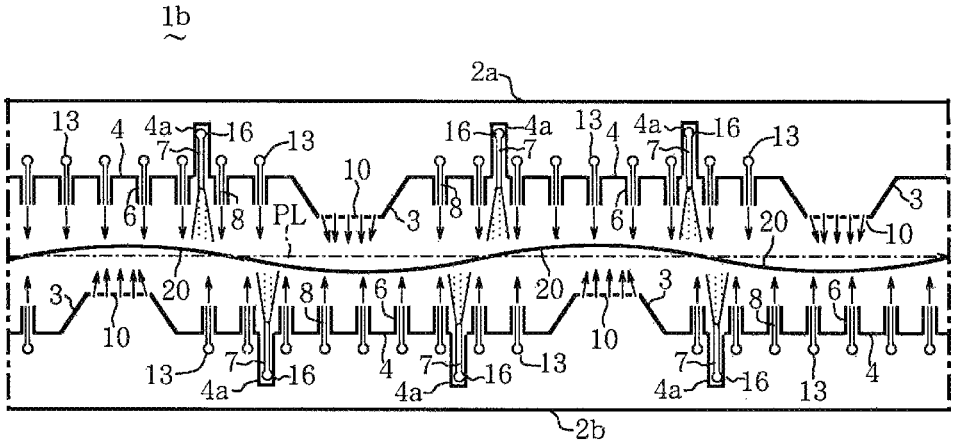
FIG. 9A is a vertical cross-sectional view illustrating a thermal treatment chamber of a different form.
Figure 9B:
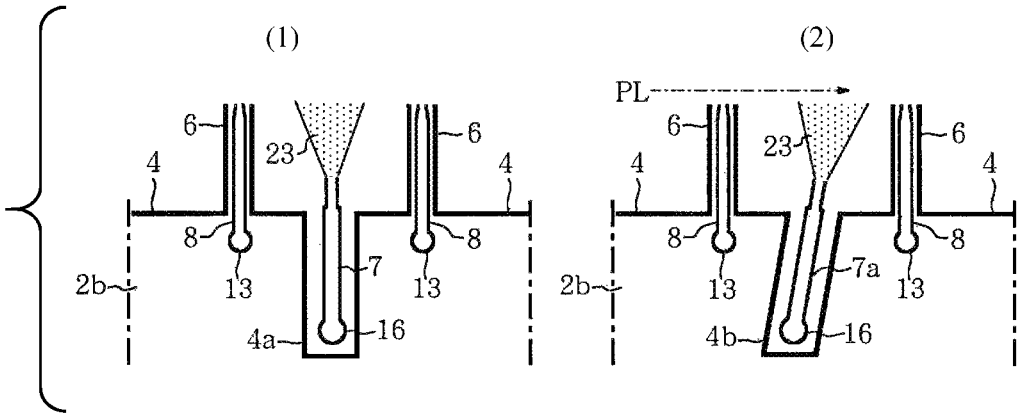
FIG. 9B include (1) and (2) that are vertical cross-sectional views illustrating the vicinities of water droplet injection nozzle of different forms in the thermal treatment chamber of FIG. 9A.
Figure 9C:
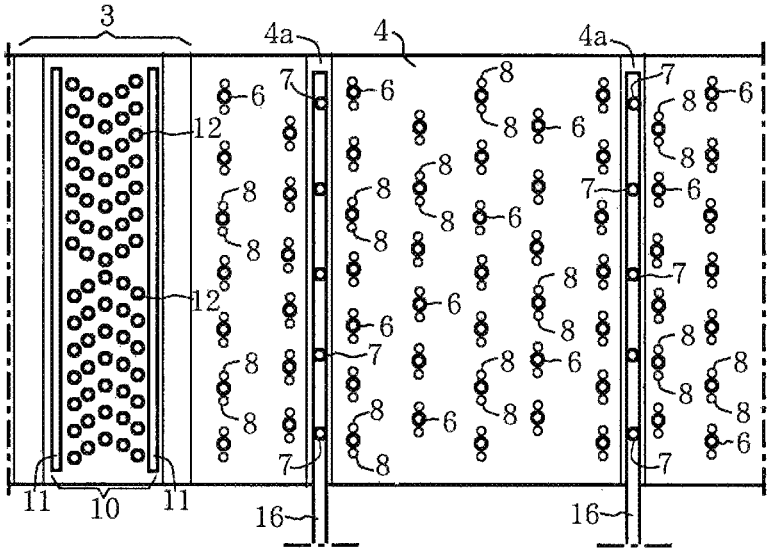
FIG. 9C is a partial plan view similar to FIG. 2C, illustrating a lower duct in FIG. 9A.

FIG. 9A is a vertical cross-sectional view illustrating a main part of a thermal treatment chamber 1*b* having a different form in the thermal treatment furnace 1, and FIG. 9C is a partial plan view of the duct 2*b* on the lower side.

As illustrated in FIG. 9A and FIG. 9C, the thermal treatment chamber 1*b* is provided with upper and lower ducts 2*a* and 2*b* and a pair of side walls 5 connecting between both side surfaces of the ducts 2*a* and 2*b*. The upper and lower ducts 2*a* and 2*b* include a projection portion 3 having the same air pad 10 as described above and a horizontal surface 4 including a plurality of sets of the air nozzle 6 and one to four mist nozzle(s) 8. Furthermore, in the thermal treatment chamber 1*b* of this form, a plurality of water droplet injection nozzles (hereinafter simply referred to as water droplet nozzles) 7 are arranged on the upper side and the lower side of the pass line PL in a plurality of rows, which are spaced apart from each other, along the direction orthogonal to the pass line PL in the horizontal surface 4 of the ducts 2*a* and 2*b*.

The water droplet nozzle 7 continuously injects multiple water droplets having the diameter of a water droplet particle of 100 μm or more. The upper limit value of the diameter of the water droplet particle may be approximately 1 mm.

As illustrated in FIG. 9A and (1) of FIG. 9B, on the horizontal surface 4 of the ducts 2*a* and 2*b*, a plurality of recessed grooves 4*a* having an oblong (rectangular) vertical cross section is formed along the direction orthogonal to the pass line PL, so as to be orthogonal to the pass line PL, between the groups of the air nozzle 6 and the mist nozzle(s) 8 arranged along the pass line PL. On the vicinity of the ceiling surface or the bottom surface of each recessed groove 4*a*, water supply pipes 16 piped in the same manner as described above are disposed along the horizontal direction and a plurality of water droplet nozzles 7 are provided on the water supply pipe 16 so as to be directed downward or upward.

Also in this form, the air nozzle 6*a* may be used instead of the air nozzle 6, or any of the mist nozzles 8*a* and 8*b* may be used instead of the mist nozzle 8.

Furthermore, as illustrated in (2) of FIG. 9B, instead of the recessed groove 4*a* having a rectangular vertical cross section, a plurality of recessed grooves 4*b* may be formed such that the opening portion is a vertically-elongated parallelogram shape whose vertical cross section is inclined within the range of approximately 5 to 25 degrees toward the downstream side of the pass line PL with respect to an imaginary vertical line. And a plurality of water droplet nozzles 7*a* inclined in the same manner as described above may be arranged from the water supply pipe 16 piped near the ceiling surface or the bottom surface of each recessed groove 4*b*.

Depending on conditions such as cooling rate of the thin metal sheet 20, the recessed groove 4*a* and the water droplet nozzle 7*a* can be inclined within the range of approximately 5 to 25 degrees toward the upstream side of the pass line PL with respect to the imaginary vertical line.

In addition, the water droplet nozzle which is inclined only at the tip end side may be disposed in the recessed groove 4*a* having a rectangular vertical cross section.

Figure 9D:
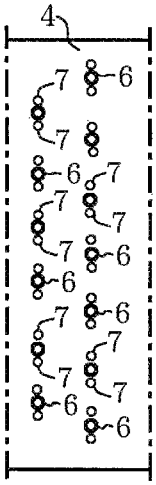
FIG. 9D is a partial plan view similar to the above, illustrating a vicinity of an air injection nozzle of still another different form.

On the other hand, as illustrated in FIG. 9D, a pair of water droplet nozzles 7 can be arranged adjacent to each of the plurality of air nozzles 6 arranged in a houndstooth pattern in plan view on the horizontal surface 4 of the ducts 2*a* and 2*b*. In such a configuration, the water supply pipe 16 is piped in the interiors of the ducts 2*a* and 2*b* in parallel to the horizontal surface 4, and a plurality of water droplet nozzles 7 are projected from the water supply pipe 16 into the thermal treatment chamber 1*b* through the horizontal surface 4.

The plurality of air nozzles 6 may be arranged in a lattice pattern in plan view.

In addition, the water droplet nozzle 7 may have a tip portion inclined toward the air nozzle 6 side as in the mist nozzle 8*a*, or the water droplet nozzle 7 may be inclined with respect to the pass line PL as in the water droplet nozzle 7*a*.

Furthermore, one water droplet nozzle 7 may be arranged so as to be adjacent to one air nozzle 6 like that illustrated in FIG. 6A and FIG. 6B. Four water droplet nozzles 7 may be arranged so as to be adjacent to and point-symmetrical with respect to one air injection nozzle 6 in plan view like that illustrated in FIG. 7A and FIG. 7B. And a pair of water droplet nozzles 7*a* similarly inclined may be arranged so as to be adjacent to one inclined air nozzle 6 like that illustrated in FIG. 8A and FIG. 8B.

In the thermal treatment chamber 1*b* as described above, the high pressure air 21 and the mist 22 are injected onto both surfaces of the thin metal sheet 20 by using the air nozzles 6 (6*a*) and the mist nozzles 8 (8*a*, 8*b*) in combination, and thus the effects (1) and (2) can be achieved.

Alternatively, the high pressure air 21 and multiple water droplets 23 are injected onto both surfaces of the thin metal sheet 20 by using the air nozzles 6 (6*a*) and the water droplet nozzles 7 (7*a*) in combination, and thus the effects (1) and (2) can be achieved, too.

In addition, since the cooling efficiency and the cooling rate can be further enhanced by using the high pressure air 21 from the air nozzles 6 (6*a*) and multiple water droplets 23 injected from the water droplet nozzles 7 (7*a*) in combination, and thus the effect (1) can be further enhanced.

Furthermore, the cooling efficiency and the cooling rate of the thin metal sheet 20 can be remarkably enhanced by using the three types of nozzles in combination, including the air nozzles 6 (6*a*), the mist nozzles 8 (8*a*, 8*b*), and the water droplet nozzles 7 (7*a*).

In addition, depending on the thickness of the thin metal sheet 20, the heating temperature and the like, three types of cooling patterns can be easily selected and utilized, including using the air nozzles 6 (6*a*) and the mist nozzles 8 (8*a*, 8*b*) in combination, using the air nozzles 6 (6*a*) and the water droplet nozzles 7 (7*a*) in combination, or using three of the air nozzles 6 (6*a*), the mist nozzles 8 (8*a*, 8*b*), and the water droplet nozzles 7 (7*a*) in combination.

The present invention is not limited to the embodiments described above.

For example, the thin metal sheet 20 may be, for example, a rolled steel, a steel sheet formed of special steel or a titanium alloy sheet, having a sheet thickness of 3 mm or less.

In addition, for each horizontal surface 4 of the ducts 2*a* and 2*b*, sets of the air nozzle 6 (6*a*) and the mist nozzle(s) 8 (8*a*, 8*b*), or sets of the air nozzle 6 (6*a*) and the water droplet nozzle(s) 7 (7*a*) may be arranged in a houndstooth pattern or a lattice pattern at substantially equal intervals in plan view.

In addition, an independent air nozzle may be provided. That is, there may be an air nozzle arranged to be adjacent to neither of mist spray nozzle nor water droplet injection nozzle.

Furthermore, the mist supply pipe 13 for feeding the mist 22 to the mist nozzles 8 (8*a*, 8*b*) or the water supply pipe 16 for supplying high pressure water to the water droplet injection nozzles 7 (7*a*) may be piped in a direction parallel to or obliquely intersecting the pass line PL in plan view for each hollow portion of the ducts 2*a* and 2*b*.

In addition, three types of the air nozzles 6 (6*a*), mist nozzles 8 (8*a*, 8*b*), and water droplet nozzles 7 (7*a*) may also be arranged in the cooling chamber 1*c* in the same manner as in the thermal treatment chamber 1*b*.

Furthermore, the projection portion 3 may have an outer shape of a semicircular, semi-elliptical or semi-oval shape in the vertical cross section, and the air pad 10 may be arranged near the top surface or near the bottom surface thereof.

In addition, the thermal treatment performed in the thermal treatment chamber 1*b* is not limited to the quenching, but includes annealing, solution treatment and the like.

In addition, the roller 17 may also be installed on the entrance side of the heating chamber 1*a* or the exit side of the cooling chamber 1*c*.

The present application is based on Japanese Patent Application No. 2017-131112 filed on Jul. 4, 2017 and on Japanese Patent Application No. 2018-078044 filed on Apr. 14, 2018, which contents are incorporated herein by reference.

INDUSTRIAL APPLICABILITY

The present invention can reliably provide a thermal treatment furnace capable of enhancing cooling efficiency for a thin metal sheet during a thermal treatment or after the thermal treatment, which is conveyed along the horizontal direction while being floated by air, and capable of easily selecting various cooling rates.

DESCRIPTION OF REFERENCE NUMERALS AND SIGNS

1 Thermal treatment furnace
1*a* Heating chamber
1*b* Thermal treatment chamber
1*c* Cooling chamber
6, 6*a* Air injection nozzle
7, 7*a* Water droplet injection nozzle
8, 8*a*, 8*b* Mist spray nozzle
17 Roller
20 Thin metal sheet
PL Pass line

The invention claimed is:

1. A thermal treatment furnace for performing a thermal treatment on a thin metal sheet while continuously conveying the thin metal sheet through a heating chamber, a thermal treatment chamber, and a cooling chamber while floating the thin metal sheet, wherein at least the thermal treatment chamber comprises a plurality of air injection nozzles and a plurality of mist spray nozzles, or the plurality of air injection nozzles and a plurality of water droplet injection nozzles, wherein the plurality of air injection nozzles and the plurality of mist spray nozzles, or the plurality of air injection nozzles and the plurality of water droplet injection nozzles are arranged along a pass line of the thin metal sheet in the thermal treatment chamber, on a lower side and an upper side of the pass line and so as to be orthogonal or oblique to the pass line in a side view, wherein the mist spray nozzles or the water droplet injection nozzles are arranged to be adjacent to each of the air injection nozzles and in parallel with each other, and wherein the mist spray nozzles or the water droplet injection nozzles are configured such that at least a tip portion of the mist spray nozzles or a tip portion of the water droplet injection nozzles is inclined toward the adjacent air injection nozzle.

2. The thermal treatment furnace according to claim 1, wherein groups of the plurality of air injection nozzles and the plurality of mist spray nozzles or groups of the plurality of air injection nozzles and the plurality of water droplet injection nozzles are alternately arranged on the lower side and the upper side of the pass line along the pass line.

3. The thermal treatment furnace according to claim 1, further comprising a roller supporting the thin metal sheet from the lower side on the lower side of the pass line on at least one of a vicinity of a boundary between the heating chamber and the thermal treatment chamber and a vicinity of a boundary between the thermal treatment chamber and the cooling chamber.

4. The thermal treatment furnace according to claim 1, wherein a distance between the air injection nozzles and the mist spray nozzles or a distance between the air injection nozzles and the water droplet injection nozzles is the same as or smaller than an outer diameter of one of the air injection nozzles, the mist spray nozzles, and the water droplet injection nozzles.

5. The thermal treatment furnace according to claim 1, wherein the thermal treatment chamber further comprises an upper duct, a lower duct, a plurality of projection portions arranged alternately along a longitudinal direction the upper and lower ducts, and air pads provided on the projection portions of the upper and lower ducts.

6. The thermal treatment furnace according to claim 3, wherein the roller is provided on:

the vicinity of the boundary between the heating chamber and the thermal treatment chamber, and the vicinity of the boundary between the thermal treatment chamber and the cooling chamber.

7. The thermal treatment furnace according to claim 1, wherein the thermal treatment chamber comprises the plurality of mist spray nozzles.

8. The thermal treatment furnace according to claim 7, wherein the plurality of air injection nozzles and the plurality of mist spray nozzles are arranged along the pass line of the thin metal sheet in the thermal treatment chamber.

9. The thermal treatment furnace according to claim 8, wherein the mist spray nozzles are arranged to be adjacent to the each of the air injection nozzles and in parallel with each other.

10. The thermal treatment furnace according to claim 9, wherein the mist spray nozzles are configured such that the at least the tip portion of the mist spray nozzles is inclined toward the adjacent air injection nozzle.

11. The thermal treatment furnace according to claim 7, wherein groups of the plurality of air injection nozzles and the plurality of mist spray nozzles are alternately arranged on the lower side and the upper side of the pass line along the pass line.

12. The thermal treatment furnace according to claim 7, wherein a distance between the air injection nozzles and the mist spray nozzles is the same as or smaller than an outer diameter of one of the air injection nozzles and the mist spray nozzles.

13. The thermal treatment furnace according to claim 1, wherein the thermal treatment chamber comprises the plurality of water droplet injection nozzles.

14. The thermal treatment furnace according to claim 13, wherein the plurality of air injection nozzles and the plurality of water droplet injection nozzles are arranged along the pass line of the thin metal sheet in the thermal treatment chamber.

15. The thermal treatment furnace according to claim 14, wherein the water droplet injection nozzles are arranged to be adjacent to each of the air injection nozzles and in parallel with each other.

16. The thermal treatment furnace according to claim 15, wherein the water droplet injection nozzles are configured such that the at least the tip portion of the water droplet injection nozzles is inclined toward the adjacent air injection nozzle.

17. The thermal treatment furnace according to claim 13, wherein groups of the plurality of air injection nozzles and the plurality of water droplet injection nozzles are alternately arranged on the lower side and the upper side of the pass line along the pass line.

18. The thermal treatment furnace according to claim 13, wherein a distance between the air injection nozzles and the water droplet injection nozzles is the same as or smaller than an outer diameter of one of the air injection nozzles and the water droplet injection nozzles.

* * * * *